United States Patent [19]

Whitney

[11] 4,290,545

[45] Sep. 22, 1981

[54] METHOD OF ATTACHING A PROTECTIVE CAP TO A SHREDDER COMPONENT

[75] Inventor: Richard P. Whitney, East Moline, Ill.

[73] Assignee: Sivyer Steel Corporation, Milwaukee, Wis.

[21] Appl. No.: 143,392

[22] Filed: Apr. 24, 1980

Related U.S. Application Data

[62] Division of Ser. No. 16,026, Feb. 28, 1979, Pat. No. 4,222,530.

[51] Int. Cl.[3] ..... B02C 13/28

[52] U.S. Cl. ..... 228/139

[58] Field of Search ..... 228/135, 138, 139, 140; 241/194, 197

[56] References Cited

U.S. PATENT DOCUMENTS

| | | | |
|---|---|---|---|
| 1,836,384 | 12/1931 | Mohr | 228/135 X |
| 2,165,032 | 7/1939 | Brown | 228/140 X |
| 3,367,585 | 2/1968 | Ratkowski | 241/197 |
| 3,482,788 | 12/1969 | Newell | 241/194 X |
| 3,727,848 | 4/1973 | Francis | 241/194 |

FOREIGN PATENT DOCUMENTS

| | | | |
|---|---|---|---|
| 866945 | 7/1949 | Fed. Rep. of Germany | 228/135 |
| 112750 | 1/1918 | United Kingdom | 228/139 |

*Primary Examiner*—Robert D. Baldwin
*Attorney, Agent, or Firm*—Quarles & Brady

[57] ABSTRACT

Replaceable protective means for protecting an end disc of a rotor shredder from excessive wear includes a protective cap of hardened, wear resistant metal, and at least two pins and washers of readily weldable metal. The protective cap has a U-shaped channel for receiving a curved portion of the periphery of the end disc. The opposed walls of the U-shaped channel each have at least one pair of pin-receiving openings and the openings in each wall are aligned with those in the opposed wall. When the cap is positioned in place on the end disc with the pin receiving openings in the opposed walls of the cap aligned with openings which extend through the end disc, the pins which have enlarged heads at one end which are larger than the openings in the disc can be inserted into the aligned openings and secured in place by welding a washer which also is larger in diameter than the openings in the disc to the other end of each of the pins. The protective cap is thus retained in place on the end disc by the welded pin and washer combinations which are not directly attached to either the cap or the end disc. The protective cap may be provided with a dependent skirt so that it protects not only the edge or periphery of the end disc, but also interior areas which are subject to wear.

4 Claims, 5 Drawing Figures

Fig. 3
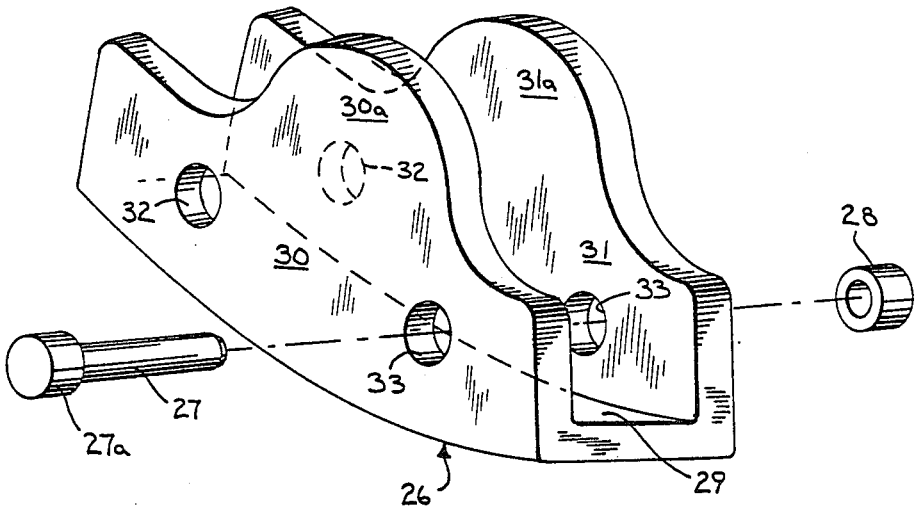
Fig. 4
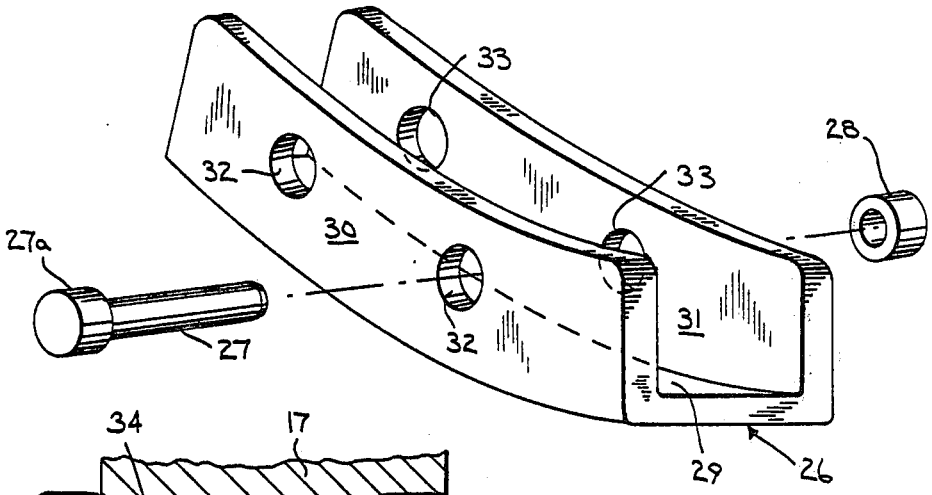
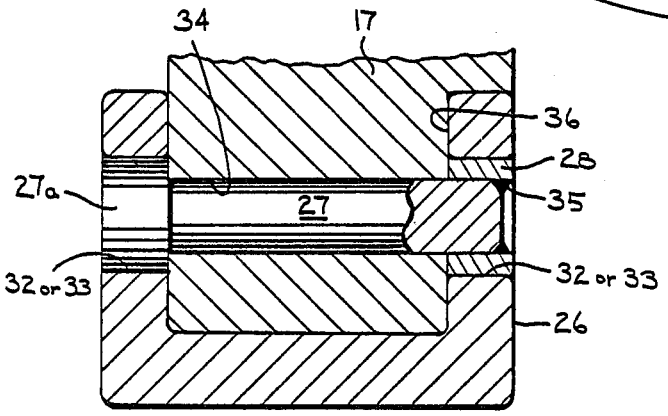
Fig. 5

METHOD OF ATTACHING A PROTECTIVE CAP TO A SHREDDER COMPONENT

This is a division of application Ser. No. 16,026, filed Feb. 28, 1979, now U.S. Pat. No. 4,222,530, issued Sept. 16, 1980.

This invention relates generally to shredders for shredding scrap metal objects such as automobile bodies. More particularly, it relates to replaceable protective means for prolonging the useful life of shredder components.

BACKGROUND OF THE INVENTION

Shredders of the type which are widely used to reduce metal objects such as automobile bodies into small manageable pieces are shown and described in the Newell U.S. Pat. No. 3,482,788. Such shredders include a housing, a rotary hammer assembly, means for rotating the hammer assembly, and a comb and grate bars which cooperate with the hammers to fragmentize or shred the objects.

The performance and efficiency of the Newell type shredder has been significantly improved by employing in the Newell housing a spider arm rotary hammer assembly such as shown in the Francis U.S. Pat. No. 3,727,428. As seen in the Francis patent, the ends of the spider arms are protected from premature wear by the replaceable protective caps.

The use of replaceable caps has reduced the downtime which resulted from excessive wear of the spider arms. However, significant downtime still can occur because of wear of other components by the rotor assembly, especially the end discs. The end discs are solid discs of metal positioned at each end of the hammer assembly which rotate with the rotary assembly and retain the shredded materials within the path of the hammers. The portion of the end disc which is especially subject to wear as the result of contact with shredded materials is its edge or periphery. Previous attempts to prolong the useful life of the end discs have comprised rebuilding the worn surfaces by sputtering metal thereon which is time consuming and thus costly or attempting to weld protective coverings on the disc. However, welding to the discs is undesirable because it can cause stresses in the metal which weaken the disc and/or the protective coverings.

SUMMARY OF THE INVENTION

The replaceable protective means of the present invention includes a protective cap of hardened, wear resistant metal and at least two pins and washers of readily weldable metal which cooperate with the end disc and cap to secure the cap in place without welding directly to either the cap or disc.

The preferred protective cap has a curved U-shaped channel for receiving a similarly curved portion of the periphery of the end disc and each of the opposed walls of the U-shaped channel have at least one pair of pin-receiving openings. The openings in each wall are aligned with those in the opposed wall. When the cap is positioned in place on the end disc with the pin-receiving openings in the opposed walls aligned with pin-receiving openings extending through the end disc, the pins which have an enlarged head at one end can be inserted through the aligned openings. The washers are then secured to the other ends of the pins by welding. The pins and washers are welded only to each other.

Thus, potentially weakening welding to the cap or disc is eliminated. When it is desired to remove the protective cap, the welded bond between the washer and pin can be readily broken without any danger of damaging the end discs and the pins removed from the aligned openings to free the cap.

In one embodiment, the protective cap includes a protective skirt to also protect interior areas of the disc from erosion and wear.

It is an object of the present invention to disclose replaceable, protective means for the end disc of the shredder which will prolong its useful life.

It is a further object of the invention to provide protective means which can be quickly and easily replaced so as to reduce the amount of downtime which occurs when an end disc must be replaced or repaired.

It is a still further object to disclose a method of attaching a protective cap to a shredder component without welding directly to the cap or the component.

The forementioned and other objects of the invention will be apparent to those skilled in the art from the description and drawings which follow which illustrate the practice of the present invention.

BRIEF DESCRIPTION OF THE DRAWINGS

FIG. 3 is a perspective view showing one embodiment of the replaceable cap and a pin and a washer of the present invention;

FIG. 4 is a perspective view of another embodiment of the replaceable cap; and FIG. 5 is an enlarged, sectional view taken along lines 5—5 of FIG. 1.

DESCRIPTION OF THE PREFERRED EMBODIMENT

Figure 1:
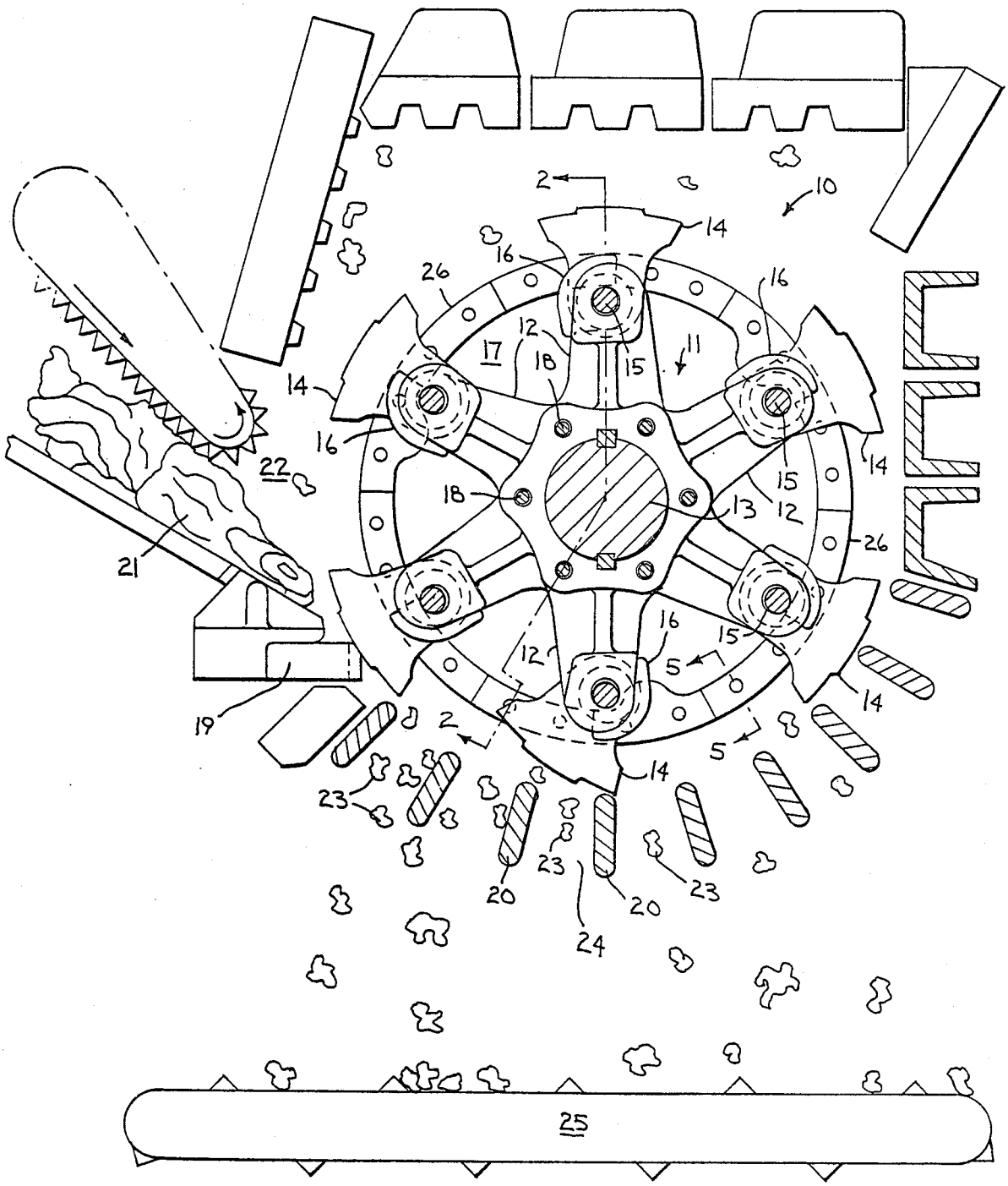
FIG. 1 is a sectional view through a shredder embodying the present invention.

Referring to the accompanying drawings, the numeral 10 designates generally a fragmentizing chamber of a shredder or hammermill which has a rotary hammer assembly 11 mounted therein. The hammer assembly 11 comprises a series of six arm spiders 12 which are mounted on and keyed to a shaft 13. Hammers 14 are mounted on hammer pins 15 which extend through the ends of the spider arms so that the hammers 14 can swing freely. The ends of the arms of the spider 12 are equipped with protective caps 16 which are described in the Francis U.S. Pat. No. 3,727,848.

Figure 2:
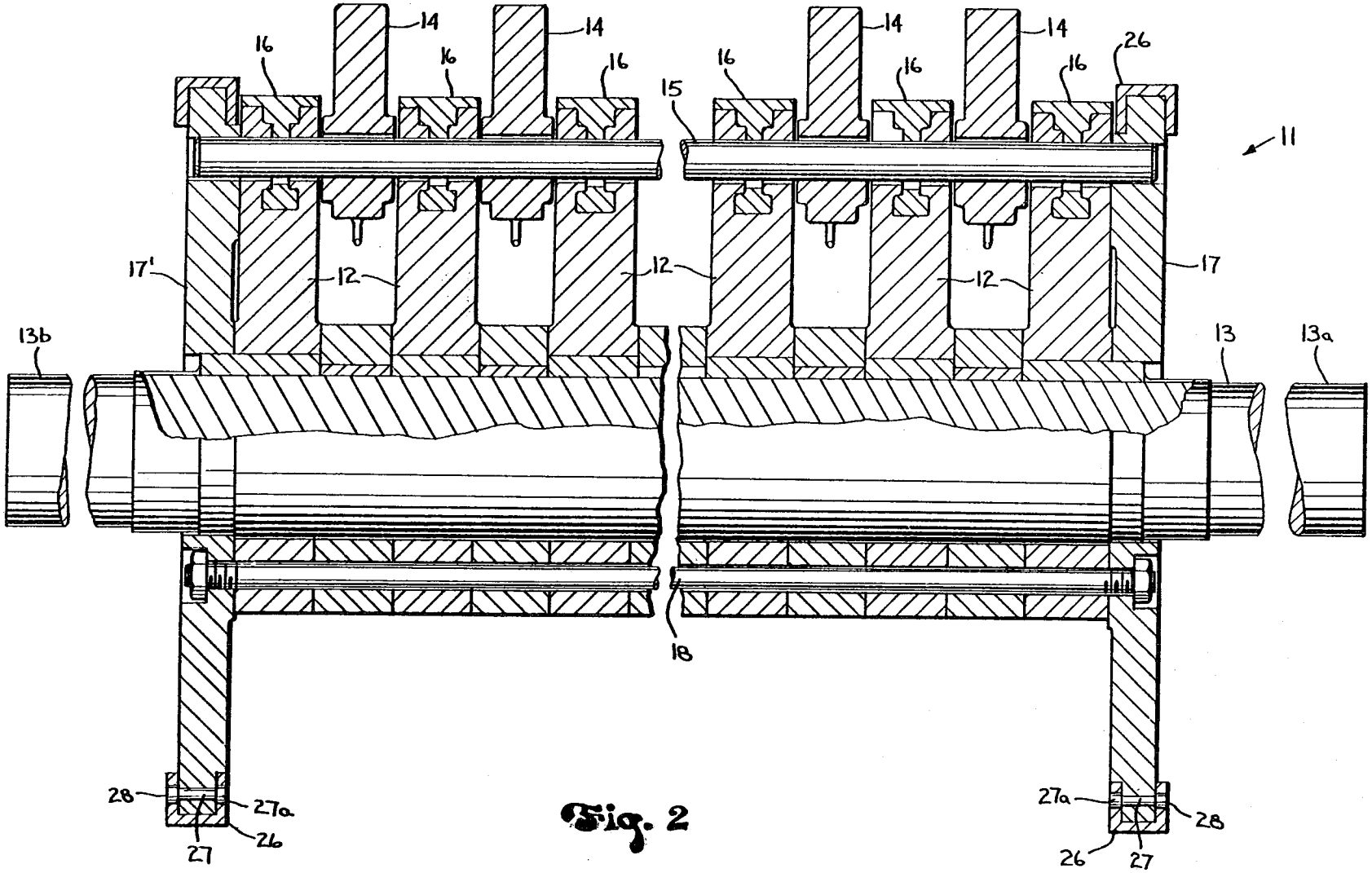
FIG. 2 is a partial, sectional view of the rotary hammer assembly of the shredder of FIG. 1 taken along lines 2—2 of FIG. 1.

As seen best in FIG. 2, a pair of end discs 17,17' are mounted on and keyed to the shaft 13 at each end outside of the series of spiders 12. The ends, **13*a*,13*b*, of shaft 13 extend through and past the end discs 17,17' and are received in bearings (not shown) that are structurally supported by the side walls of the shredder housing. The series of spiders 12 and the end discs 17,17' are secured together with tie rods 18** and are rotated as a unitary assembly by a motor (not shown).

Referring now to FIG. 1, the operation of the shredder will be described. In operation, the free swinging hammers 14 rotate with the rotary hammer assembly 11 and coact with the teeth of a rigidly mounted cutting comb 19 that extends the length of the rotary hammer assembly 11 and with the cutter bars 20 that are circumferentially spaced about the lower part of the orbit of the hammer circle to break up any material 21 entering the shredder through the inlet 22. When the pieces or fragments 23 into which the shredder breaks the incoming material reach a desired size, they fall through the spaces 24 between the cutter bars 20 onto a delivery conveyor 25 which carries them from the shredder housing. The end discs 17,17' which rotate with the shaft 13 cooperate with the walls of the chamber 10 to prevent the shredded pieces from leaving the chamber except through the openings 24 between the cutter bars 20.

The hammers 14, the comb 19 and cutter bars 20 which coact to shred the material entering the shredder are of specially treated, hardened steel. The spider arms 12 and the end discs 17,17' because of their size and shapes are more effectively cast of softer steel. Although in operation the hammer 14, comb 19 and cutter bars 20 are subjected to most of the impact and wear associated with the shredding of scrap objects, the shredded pieces 23 do contact and cause erosion and wear of the spider arms 12 and end discs 17,17' as well. The area most susceptible to wear on the spider arm 12 is the leading edge portion and on end discs 17,17' it is the circumferential edge or periphery of the disc.

The protective caps 16 which are of hard, wear resistant steel protect the leading edges of the spider arms 12. The protective caps 16 are secured to the ends of the arms 12 using a mortise and tenon type joint and are retained in position by the hammer pins 15. Thus, welding that might cause weakening stresses in the metal of the cap 16 or the arms 12 is avoided. The caps 16 and their method of attachment are described in greater detail in the previously mentioned Francis patent.

The periphery and interior areas of the end discs 17,17' which are subject to wear may be protected with the replaceable protective means shown in FIGS. 3, 4 and 5 which can be attached to the end disc without welding in a manner to be described.

In FIG. 3, an embodiment of the protective means of the present invention can be seen that includes a protective cap 26 of specially hardened steel and a pin 27 and a washer 28 of weldable metal. The protective cap 25 has a generally U-shaped channel 29 which is shaped to receive a portion of the periphery of the end disc 17. The opposed walls 30,31 of the channel 29 each have an integral skirt **30*a*,31*a* and are provided with a pair of apertures or openings 32,33. The openings 32,33, respectively, of the opposed walls 30,31 are aligned. As a result, when the cap 26 is positioned upon the end disc 17, the openings 32,33 can be aligned with similar openings 34 (seen best in FIG. 5) in the end disc 17 and the pins 27 can be inserted to extend through the aligned opening. The pins 27 are preferably inserted from the chamber side of the end disc so that the head 27*a* is received in the opening 32 of the wall 30, as seen best in FIGS. 2 and 5. When the pins 27 are in place in the aligned openings, a washer 28 is placed upon the free end of each of the pins 27 and welded as at 35 to the pin 27, as seen in FIG. 5**.

The openings 34 in the end discs 17,17' through which the body of the pins 27 extend have a diameter which is only slightly larger than the diameter of the body portion of the pin 27, but which is smaller than the head **27*a* of the pin and the washer 28. As a result, when the pin 27 is in place and the washer 28 is welded thereto the head 27*a* and washer 28 cooperate to prevent the pin 27 from being removed. If it is desired to remove the cap 26, the weld 35 between the pin 27 and washer 28 can be broken as with a welding torch and the pin 27 knocked out of the aligned openings in the cap 26 and end disc 17**.

As seen in FIGS. 2 and 5, an area 36 adjacent the periphery or outer edge of the end discs 17,17' is of reduced thickness so that when the protective cap 26 is mounted in place the surface of the wall 30 of the cap 26 is flush with the inner wall of the discs 17,17', thus providing a smooth less likely to wear surface.

In the preferred embodiment shown in the drawings, the openings 32 and 33 are of only slightly larger diameter than the outer diameter of the head **27*a* and the washer 28 so that the head 27*a* and washer 28 when secured in the openings 32 and 33 will not only retain the cap 28 to the disc 17**, but prevent it from moving or wobbling once in place.

Another embodiment of the replaceable cap 26 which does not have walls with integral skirts is shown in FIG. 4. This embodiment of the cap can be used on those areas of the end disc in which the inner areas of the disc need not be protected from erosion and wear.

It will be readily apparent to those skilled in the art that the novel method of attaching the replaceable cap in place without welding on either the cap or the surface being protected can be applied with advantage to protect other metal surfaces subject to wear. Therefore, it is intended that such application of the method be covered by the claims which follow.

I claim:

1. The method of attaching a protective cap to a shredder component without welding directly upon the cap or the component which comprises:

(a) providing a protective cap having a generally U-shaped channel with opposed walls for receiving a portion of the component desired to be protected, said opposed walls each having at least two openings extending therethrough with respective openings in opposed walls being aligned;

(b) providing the component with at least two openings which are aligned with the openings in the channel walls when the cap is in place said component openings being of less diameter than said channel wall openings;

(c) positioning the cap upon the component with the openings aligned;

(d) inserting pins through at least two of the aligned openings, said pins having a head at one end which is larger in diameter than the openings in the component but smaller in diameter than said channel wall openings, said pins being of sufficient length so that the pin extends through the aligned opening in the first wall of the cap, the opening in the component and into the opening in the second wall of the cap; and (e) then positioning at least two washers each having an outer diameter greater than the openings in the component but smaller than the openings in the channel walls about a portion of the other end of the pin and welding it thereto so that the pin and washer combinations cannot be removed from the aligned openings and will retain the cap in position on the component.

2. The method of claim 1 in which the openings in the opposed walls of the channel of the cap are only slightly larger than the outside diameter of the washer and head of the pin.

3. The method of claim 1 in which the component is the end disc of a rotary hammer assembly of a shredder.

4. The method of claim 1 in which at least one of the walls of the channel of the cap is provided with an integral protective skirt.

* * * * *